US007832800B2

(12) United States Patent
Lo

(10) Patent No.: US 7,832,800 B2
(45) Date of Patent: Nov. 16, 2010

(54) MASSAGE CHAIR WITH ANGLE ADJUSTABLE CHAIR FRAME

(76) Inventor: Chiu Hsiang Lo, No.37-2, Ching-Dau 1st Street, Taichung (TW) 404

( * ) Notice: Subject to any disclaimer, the term of this patent is extended or adjusted under 35 U.S.C. 154(b) by 394 days.

(21) Appl. No.: 12/119,223

(22) Filed: May 12, 2008

(65) Prior Publication Data

US 2009/0224578 A1 Sep. 10, 2009

(30) Foreign Application Priority Data

Mar. 7, 2008 (TW) ..... 97203877 U

(51) Int. Cl.
*A47C 1/02* (2006.01)

(52) U.S. Cl. ..... 297/330; 297/327; 297/329

(58) Field of Classification Search ..... 297/325, 297/326, 327, 328, 330, 270.1, 270.2, 270.3, 297/270.4, 340, 344.1, 329
See application file for complete search history.

(56) References Cited

U.S. PATENT DOCUMENTS

| | | | | |
|---|---|---|---|---|
| 1,941,901 | A * | 1/1934 | Knabusch et al. | 297/327 |
| 3,191,990 | A * | 6/1965 | Rugg et al. | 297/330 |
| 6,213,554 | B1 * | 4/2001 | Marcoux et al. | 297/330 |
| 6,244,658 | B1 * | 6/2001 | Parent et al. | 297/270.1 |
| 7,334,840 | B2 * | 2/2008 | Deans et al. | 297/270.1 |

* cited by examiner

*Primary Examiner*—Anthony D Barfield
(74) *Attorney, Agent, or Firm*—WPAT, P.C.; Anthony King

(57) ABSTRACT

The present invention is related to one massage chair with slant angle adjustable chair frame, primarily comprising one basic frame, one chair frame, two first connecting members, two second connecting members and one linearly retractable actuator. The basic frame comprises one base frame and two support frames arranged in parallel and stretching up from said base frame. Every support frame has one first pivot portion and one second pivot portion. The chair frame has at least one set of massage chair, comprising one seat frame with two side frames. Every said side frame has one third pivot portion and one fourth pivot portion. Every first connecting member has one top end and one bottom end. The top end is pivotally connected to the first pivot portion of the corresponding support frame. The bottom end is pivotally connected to the third pivot portion of one corresponding side frame. Every second connecting member has one top end and one bottom end. The top end is pivotally connected to the second pivot portion of one corresponding support frame. The bottom end is pivotally connected to the fourth pivot portion of one corresponding side frame. The actuator has a first end and a second end. Both ends can make relatively liner retraction. The first end is pivotally connected to the basic frame. The second end is pivotally connected to the chair frame. The basic frame, the first connecting member, the second connecting member and the chair frame are pivotally connected into a four-linkage mechanism. By means of above structural designing, the adjustment of angle slanting speed can be slowed down, and a comfortable feeling can be enhanced for the user who lies down on, or leans against the massage chair.

11 Claims, 6 Drawing Sheets

MASSAGE CHAIR WITH ANGLE ADJUSTABLE CHAIR FRAME

FIELD OF THE INVENTION

The present invention is related to a massage chair with angle adjustable chair frame, especially for the chair frame which inclines gently, and enhances the comfortable feeling for the user who sits on the chair, and leans his back against the backrest of the chair.

BACKGROUND OF THE INVENTION

There are many kinds of conventional massage chairs. For enhancing comfortable feeling, all of the conventional massage chairs are designed with lying function. The user may adjust the slant angle depending on his need so as to allow his body in a lying status. Partly because of the lying, the body can relax, and partly because of the body weight on the massage chair where the body back is against, the massage force is increased.

Although the conventional massage chairs in the market or prior art all have the design of lying angle adjustment, but they all use the backrest to form a slant angle. The seat is fixed to the base, and forms a rigid body. In other words, the seat won't follow the backrest to incline. For such kind of design, the user's hips won't move. Only the body back lies. It is unable to form the best and the most comfortable rest status for the user. Besides, the backrest of the massage chair depends on single shaft to rotate. It requires gear transmission. The mechanical design of gear transmission is complicate and higher cost. It increases the difficulty and the cost of future service.

SUMMARY OF THE INVENTION

The present invention is related to a chair frame whose slanting angle is adjustable. It slows down the slanting speed for the chair frame, and enhances a comfortable feeling for the user who lies or leans against the backrest of the massage chair. The present invention intends to accomplish above purposes by using the technique and measures comprising one basic frame, one chair frame, two "first connecting members", two "second connecting members" and one linearly retractable actuator. The basic frame includes one base frame and two support frames arranged in parallel and stretching up from said base frame. Every said support frame has one "first pivot" and one "second pivot". The chair frame has at least one massage device and one seat frame with two side frames. Every said side frame has one "third pivot" and one "fourth pivot". Every first connecting member has one top end and one bottom end. The top end is pivotally connected to the first pivot of one corresponding support frame. The bottom end is pivotally connected to the third pivot of one corresponding side frame. Every second connecting member has one top end and one bottom end. The top end is pivotally connected to the second pivot of one corresponding support frame. The bottom end is pivotally connected to the fourth pivot of one corresponding side frame. Said actuator has one "first end" and one "second end". The both ends can make linear and relative stretch to each other. The first end is pivotally connected to the basic frame. The second end is pivotally connected to the chair frame. The basic frame, the first connecting member, the second connecting member and the chair frame are pivotally connected into a four-linkage mechanism.

DETAILED DESCRIPTION OF THE PREFERRED EMBODIMENT

Figure 1:
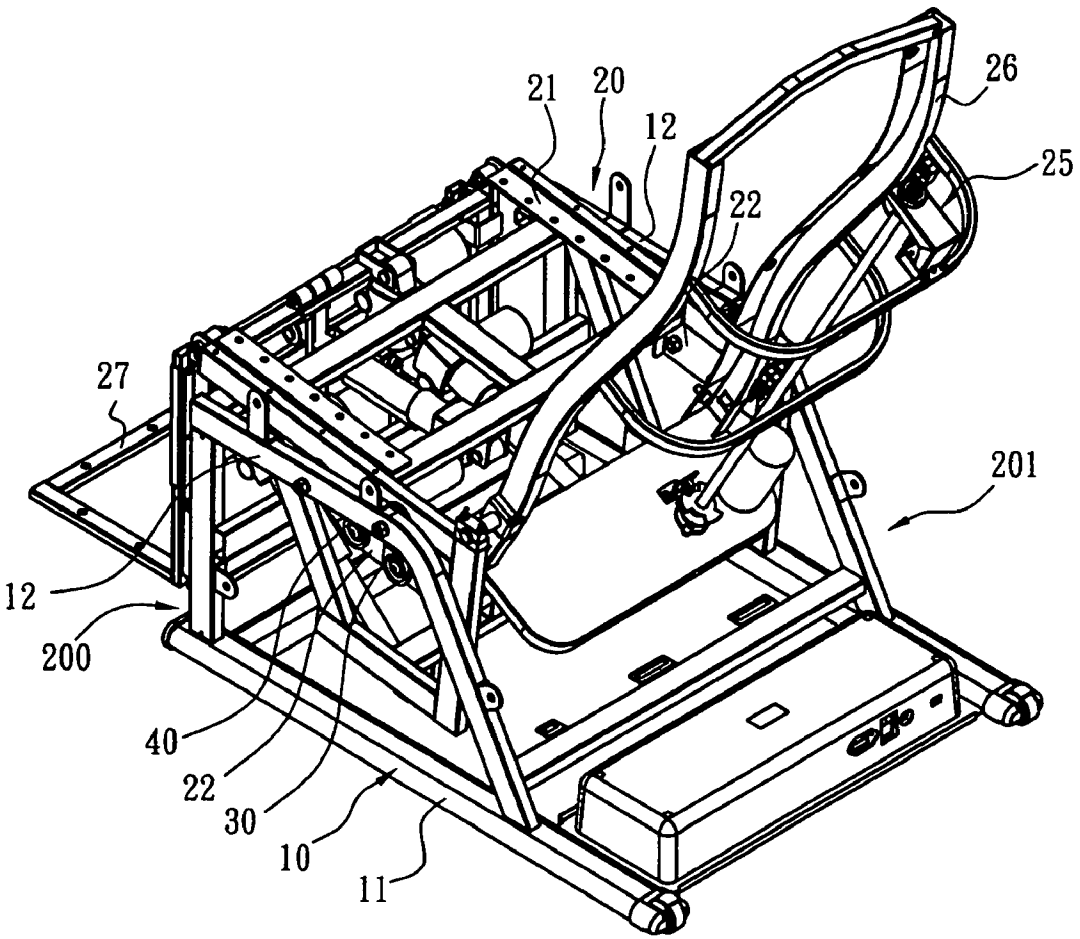
FIG. 1 is a block diagram schematically showing the first angle of the present invention.
Figure 2:
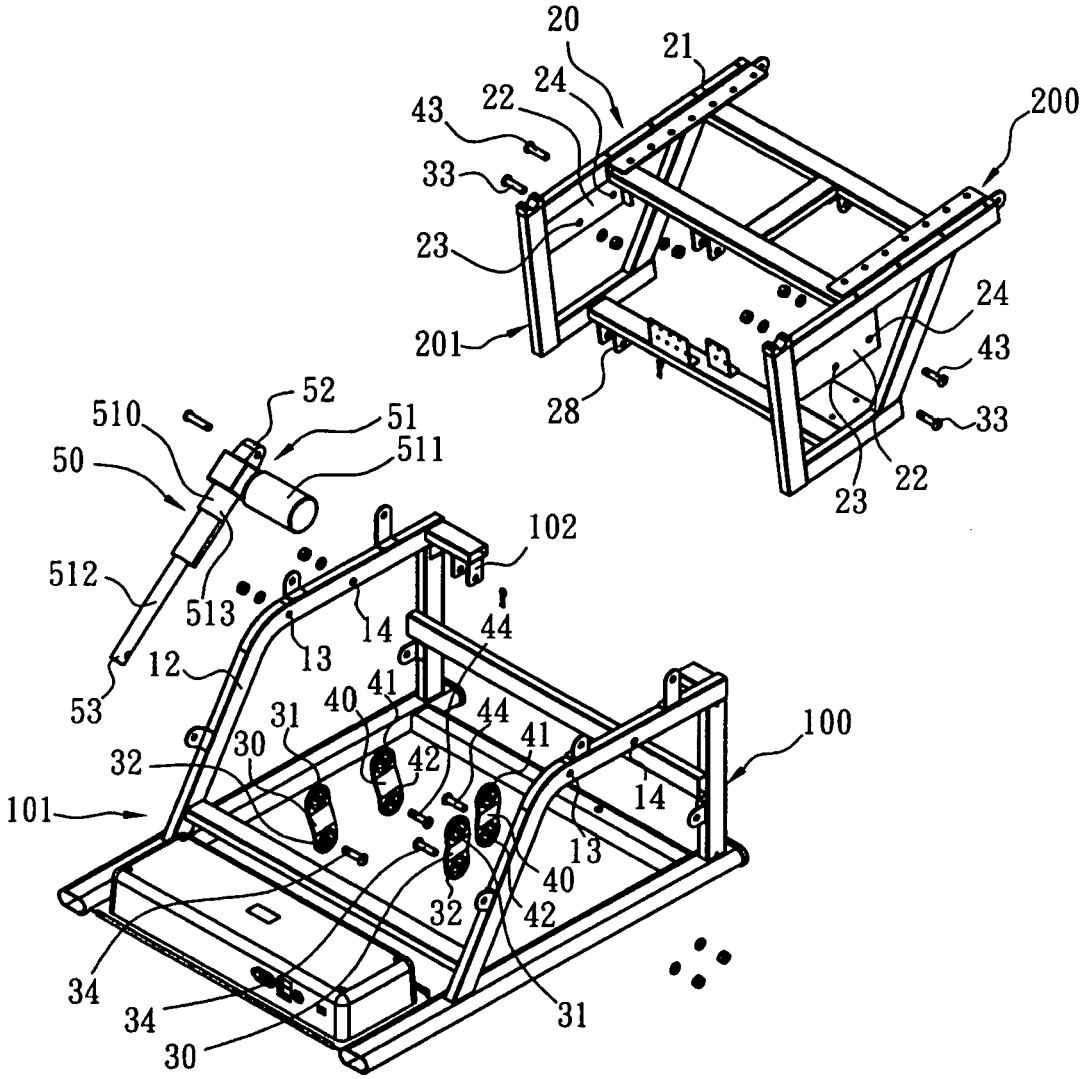
FIG. 2 is a partial exploded diagram schematically showing the basic frame and the chair frame of the present invention.

Referring to FIGS. 1-4, the present invention is a massage chair, and its chair frame is with an angle adjustment device. Its basic structure features comprises:

a basic frame 10 comprising a base frame 11 and two support frames 12 arranged in parallel, stretching up from the base frame 11, and the base frame 11 being placed on a plane 15 so as to stabilize the basic frame 10, and each support frame 12 having one first pivot portion 13 and one second pivot portion 14;

a chair frame 20, on which there is at least one set of massage device 25, the chair frame 20 comprising one seat frame 21 which includes two side frames 22, each side frame 22 having one third pivot portion 23 and one fourth pivot portion 24, the third pivot portion 23 and the fourth pivot portion 24 being closer to the base frame 11 than the first pivot portion 13 and the second pivot portion 14;

two first connecting members 30, each first connecting members 30 having one top end 31 and one bottom end 32, the pivot axis 33 inserted through the top end 31 and being respectively pivotally connected to the first pivot portion 13 of one corresponding support frame 12, the pivot axis 34 inserted through said bottom end 32 and being respectively pivotally connected to said third pivot portion 23;

two second connecting members 40, each second connecting member 40 having one top end 41 and one bottom end 42, the axis 43 inserted through said top end 41 and being respectively pivotally connected to said second pivot portion 14 of one corresponding support frame 12, the axis 44 inserted through the bottom end 42 and being respectively pivotally connected to the fourth pivot portion 24 of one corresponding side frame 22; and a linearly retractable actuator 50 having electric power source 51, by means of the power from the power source, one first end 52 being able to make a relatively linear retraction to one second end 53, the first end 52 being pivotally connected to said basic frame 10, the second end 53 being pivotally connected to said chair frame 20.

One embodiment of the linearly retractable actuator 50 is a conventional movable screw which includes one electric power driven motor 511, one transmitting device 513, one cylinder 510 and one retractable bar 512, the electric power driven motor 511 and the transmitting device 513 forming the electric power source 51 and the cylinder 510 connecting to the retractable bar 512.

After the electric power driven motor 511 is started, the power generated by the electric power driven motor 511 will be transmitted through the transmitting device 513 to the retractable bar 512. Thus, the retractable bar 512 makes a relative retraction to the cylinder 510.

As mentioned above, the basic frame 10, the first connecting member 30, the second connecting member 40 and the chair frame 20 are pivotally connected into a four-linkage mechanism. By means of the electric power source 51 of the linearly retractable actuator 50, the first end 52 and the second end 53 of the linearly retractable actuator 50 can make a relative length stretch or length retraction to each other, and control further the slant angle of the basic frame 10 of the chair frame 20.

Figure 3:
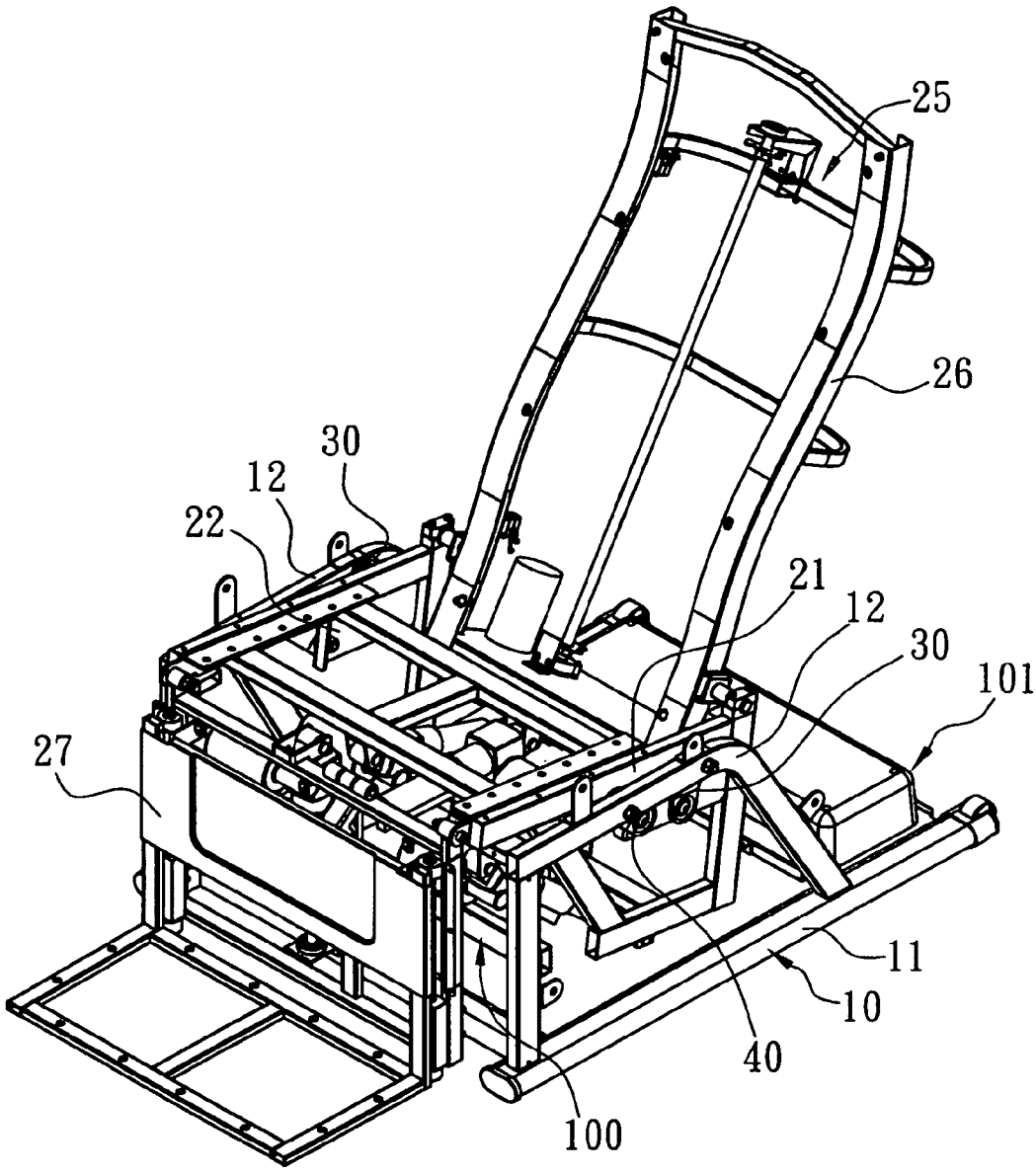
FIG. 3 is a block diagram schematically showing the second angle of the present invention, and the included angle between the seat frame and ground level is smaller.

Referring to FIGS. 1 and 3 of the exemplary embodiment of the present invention, the chair frame 20 includes further one backrest frame 26. The massage device 25 is mounted on the backrest frame 26. One further exemplary embodiment is that the backrest 26 is mounted at the rear side of the chair frame 20.

Referring to FIGS. 1 and 3 of the preferred exemplary embodiment of the present invention, the basic frame 10, the first connecting member 30, the second connecting member 40 and the chair frame 20 form the four-linkage mechanism which is a non-parallelogram linkage mechanism. By means of the difference of the travel made between the first connecting member 30 and the second connecting member 40, the slant angle of the basic frame 10 corresponding to the chair frame 20 can be controlled.

Figure 4:
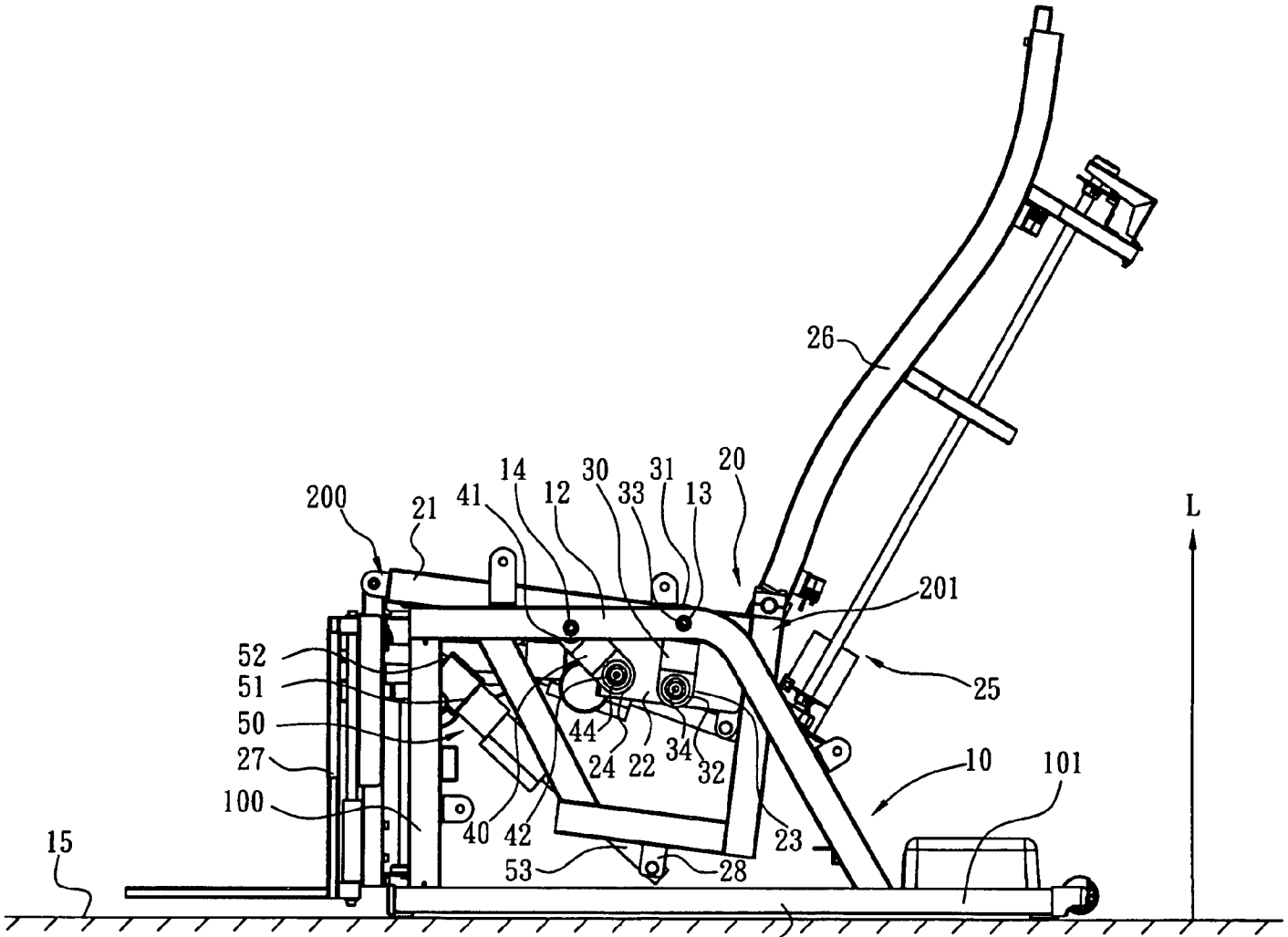
FIG. 4 illustrates a side plan view corresponding to FIG. 3.

Referring to FIGS. 1, 3 and 4 of the exemplary preferred embodiment of the present invention, the linearly retractable actuator 50 is designed to control the increment of the slant angle between the basic frame 10 and the chair frame 20 while the linearly retractable actuator 50 shortens the length. The concrete structures for achieving this function are as followings:

the basic frame 10 comprises a front end 100 and a rear end 101;

the chair frame 20 comprises a front end 200 and a rear end 201;

the first connecting member 30 is closer to the rear end 101 of the basic frame 10 than the second connecting member 40, and the included angle between the second connecting member 40 and the normal line L of the plane 15 is larger than the included angle between the first connecting member 30 and the normal line L; and the bottom of the chair frame 20 has one fifth pivot portion 28. The fifth pivot portion 28 is closer to the base frame 11 of the basic frame 10 than the third pivot portion 23 and the fourth pivot portion 24. The fifth pivot portion 28 is between the front end 100 and the rear end 101 of the basic frame 10. The second end 53 of the linearly retractable actuator 50 is pivotally connected to the fifth pivot portion 28. The first end 52 of the linearly retractable actuator 50 is pivotally connected to the position close to the front end 100 of the basic frame 10. In this exemplary embodiment, the front end 100 of the basic frame 10 has one pivot 102 which is pivotally connected to the first end 52 of the linearly retractable actuator 50.

Referring to FIGS. 1 and 3 of the exemplary preferred embodiment of the present invention, the front end 200 of said chair frame 20 has one foot rest rack 27. The foot rest rack 27 provides user's feet a stamp place, and forms a stable support status. Thus, the user can feel comfortable.

Figure 5:
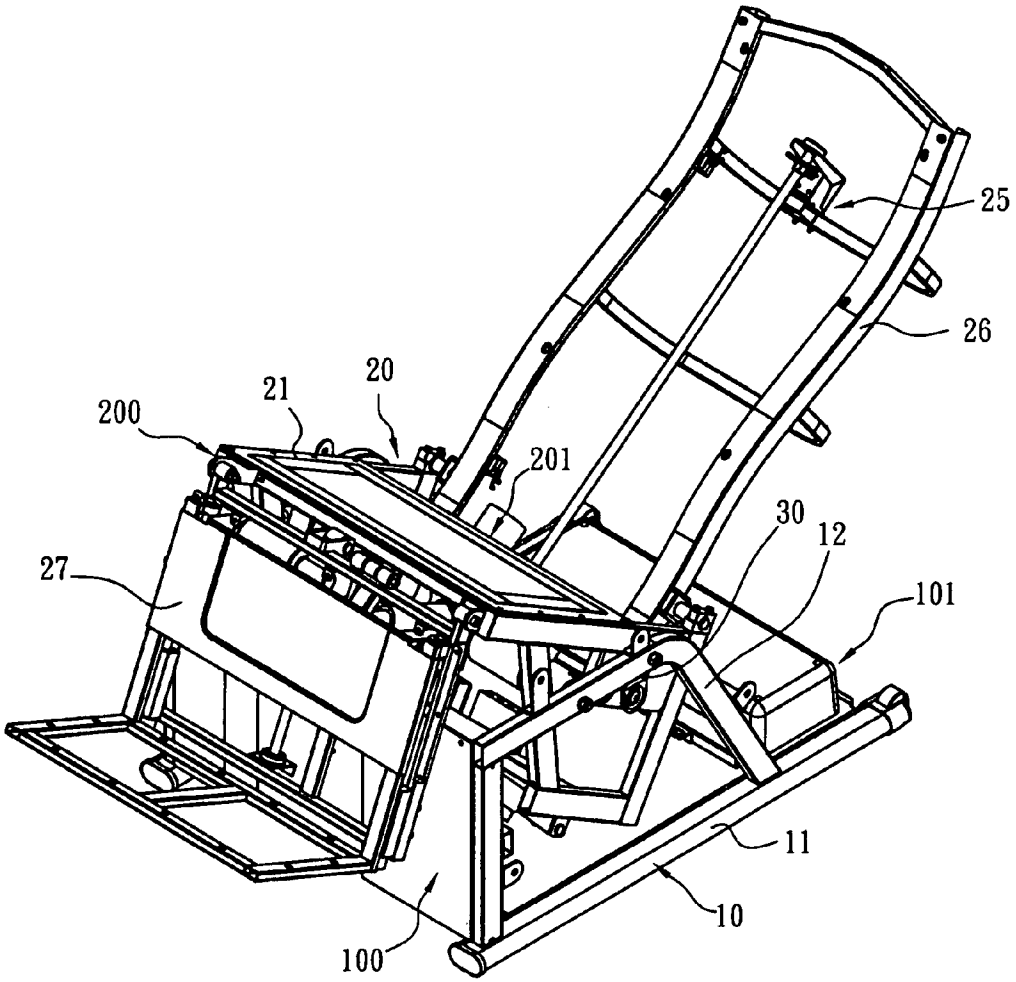
FIG. 5 is a block diagram schematically showing the second angle of the present invention, and the included angle between the seat frame and ground level is bigger.
Figure 6:
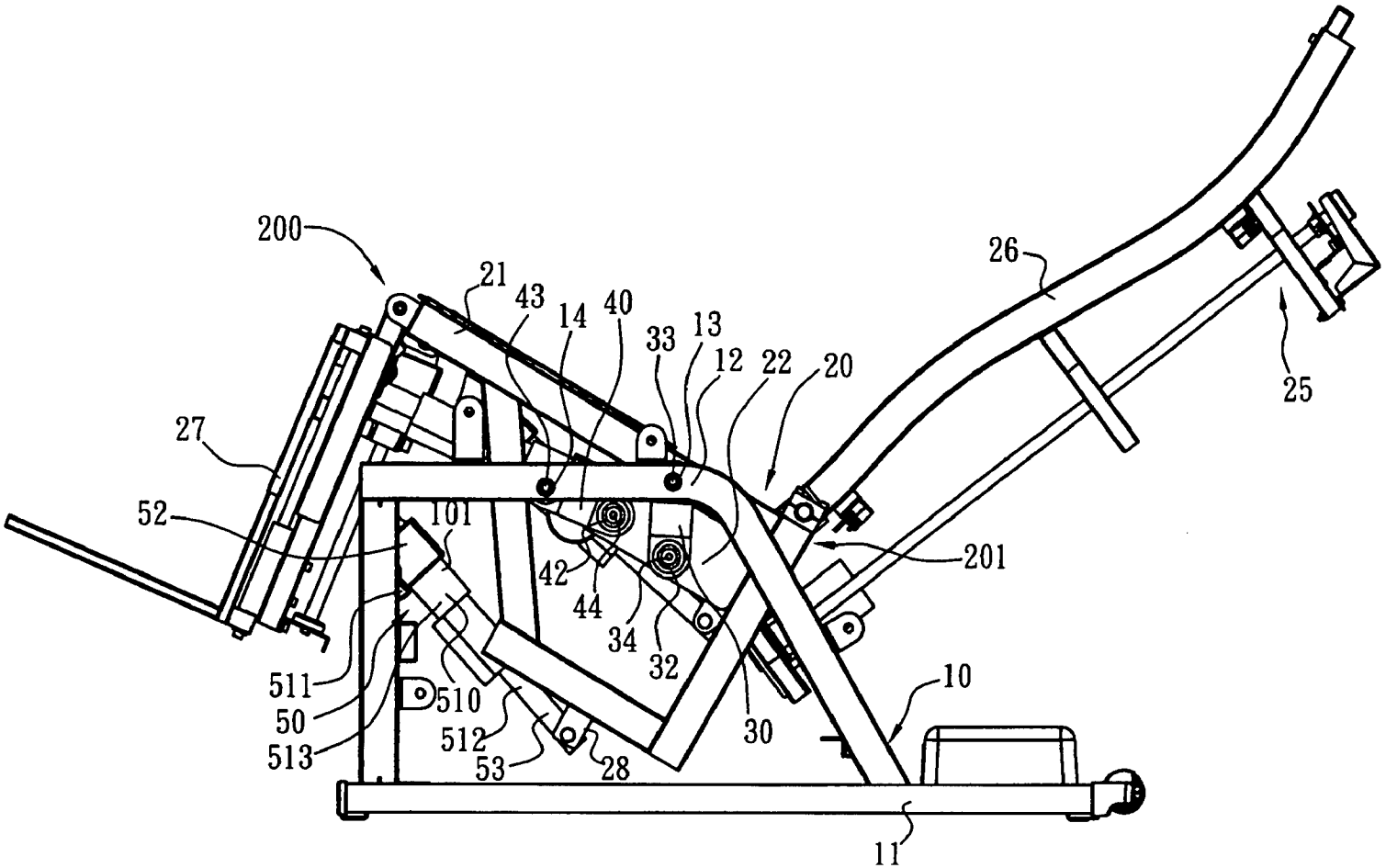
FIG. 6 illustrates a side plan view corresponding to FIG. 5.

Referring to FIGS. 3 and 4 which illustrate the seat frame 21 of the present invention is close to the level status. At this moment the distance between the first end 52 and the second end 53 of the linearly retractable actuator 50 is longer. If the user wants to increase the slant angle of the chair frame 20, he may start the linearly retractable actuator 50 so that the distance between the first end 52 and the second end 53 of the linearly retractable actuator 50 can be shorten as shown in FIGS. 5 and 6, wherein the chair frame 20 and the basic frame 10 are pivotally connected by two first connecting members 30 and two second connecting members 40. When the linearly retractable actuator 50 shortens the length, and approaches the bottom of the chair frame 20, the seat frame 21 of the chair frame 20, the backrest 26 and the foot rest rack 27 can make a relative rotation to the basic frame 10. They not only rotate, but also move. Therefore, the slanting speed of the chair frame 20 can be slowed down.

While we have shown and described the embodiment in accordance with the present invention, it should be clear to those skilled in the art that further embodiments may be made without departing from the scope of the present invention.

What is claimed is:

1. A massage chair with slant angle adjustable chair frame comprises:

a basic frame including a base frame and two support frames arranged in parallel and stretching up from the base frame, said base frame being placed on a level plane so as to stabilize said basic frame, each support frame having a first pivot portion and a second pivot portion;

a chair frame including at least one set of massage device, and a seat frame having two side frames, each side frame including a third pivot portion and a fourth pivot portion, said third pivot portion and said fourth pivot portion being closer to the base frame than the first pivot portion and the second pivot portion;

two first connecting members, each said connecting member including a top end and a bottom end, said top end being pivotally connected to the first pivot portion of said corresponding support frame, said bottom end being pivotally connected to the third pivot portion of said side frame by an axis;

two second connecting members, each said second connecting member including one top end and one bottom end, said top end being pivotally connected to the second pivot portion of said one corresponding support frame, said bottom end being pivotally connected to the fourth pivot portion of said one corresponding side frame; and an linearly retractable actuator including a first end and a second end, said first end can make a relatively linear retraction to said second end, said first end being pivotally connected to said basic frame by a shaft, said second end being pivotally connected to the chair frame;

said basic frame, said first connecting member, said second connecting member and said chair frame being pivotally connected to form a four-linkage mechanism.

2. The massage chair as claimed in claim 1, wherein the chair frame further includes one backrest frame, and said massage device is mounted to said backrest frame.

3. The massage chair as claimed in claim 1, wherein said four-linkage mechanism is a non parallelogram four-linkage mechanism.

4. The massage chair as claimed in claim 1, wherein the linearly retractable actuator can control the increment of slant angle between said chair frame and said basic frame when the actuator shortens the length.

5. The massage chair as claimed in claim 1, wherein the basic frame includes a first front end and a first rear end, said chair frame includes a second front end and a second rear end, said first connecting member is closer to said first rear end of said basic frame than said second connecting member, the included angle between said second connecting member and the normal line L of the plane is larger than the included angle between said first connecting member and said normal line, the bottom of the chair frame has one fifth pivot portion which is closer to the base frame of the basic frame than said third pivot portion and said fourth pivot portion, said fifth pivot portion is between said first front end and said first rear end of the basic frame, said second end of said linearly retractable actuator is pivotally connected to said fifth pivot portion, said first end of said linearly retractable actuator is pivotally connected to the position close to said first end of said basic frame.

6. The massage chair as claimed in claim 5, wherein said second rear end of said chair frame has a backrest.

7. The massage chair as claimed in claim 5, wherein the second front end of said chair frame has a foot rest rack.

8. A massage chair with slant angle adjustable chair frame, wherein said massage chair comprises:

a basic frame including a base frame and two support frames arranged in parallel and stretching up from the base frame, said base frame on a level plane to stabilize said basic frame, each support frame having a first pivot portion and a second pivot portion;

a chair frame including at least one set of massage device, said chair frame including a seat frame which has two side frames, each side frame having a third pivot portion and a fourth pivot portion, said third pivot portion and said fourth pivot portion are closer to the base frame than said first pivot portion and said second pivot portion;

two first connecting members, each connecting member including a top end and a bottom end, said top end being pivotally connected to the first pivot portion of said corresponding support frame by an axis, said bottom end being pivotally connected to said third pivot portion of said corresponding side frame by an axis;

two second connecting members, each second connecting member including a top end and a bottom end, said top end being pivotally connected to said second pivot portion of said corresponding support frame by an axis, said bottom end being pivotally connected to the fourth pivot portion of said corresponding side frame; and a linearly retractable actuator including a first end and a second end, said first end can make linear retraction to the relative one second end, said first end being pivotally connected to said basic frame, said second end being pivotally connected to the chair frame;

said basic frame, said first connecting member, said second connecting member and said chair frame being pivotally connected together to form a four-linkage mechanism, the linearly retractable actuator being able to control the increment of slant angle between said chair frame and said basic frame when the actuator shortens the length.

9. The massage chair as claimed in claim 8, wherein the chair frame includes a backrest frame on which the massage device is mounted.

10. A massage chair with slant angle adjustable chair frame, wherein said massage chair comprises:

a basic frame including a base frame and two support frames arranged in parallel and stretching up from said base frame, said base frame being placed on a level plane to stabilize said basic frame, each support frame including a first pivot portion and a second pivot portion;

a chair frame having at least one set of massage device, said chair frame including a seat frame which have two side frames, each side frame having a third pivot portion and a fourth pivot portion, said third pivot portion and the fourth pivot portion being closer to said base frame than the first pivot portion and the second pivot portion;

two first connecting member, each first connecting member having a top end and a bottom end, said top end being pivotally connected to the first pivot portion of said corresponding support frame, said bottom end being pivotally connected to the third pivot portion of said corresponding side frame;

two second connecting members, each second connecting member having a top end and a bottom end, said top end being pivotally connected to the second pivot portion of said corresponding support frame by an axis, said bottom end being pivotally connected to said fourth pivot of said side frame by an axis; and a linearly retractable actuator including a first end and a second end, said first end can make a relative linear retraction to said second end, said first end being pivotally connected to said basic frame, and said second end being pivotally connected to said chair frame;

wherein, said basic frame, said first connecting member, said second connecting member and said chair frame being pivotally connected to form a four-linkage mechanism, said basic frame including a first front end and a first rear end, said chair frame including a second front end and a second rear end, said first connecting member being closer to said first rear end of said basic frame than said second connecting member, the included angle between said second connecting member and its corresponding normal line being larger than the included angle between said first connecting member and its corresponding normal line, the base of said chair frame having a fifth pivot portion which is closer to the base frame of the basic frame than said third pivot portion and said fourth pivot portion, said fifth pivot portion being between said first front end and said rear end of said basic frame, said second end of said actuator being pivotally connected to said fifth pivot portion, said first end of said actuator being pivotally connected to a position near said first end of said basic frame so that said linearly retractable actuator can control the increment of slant angle of said basic frame corresponding to said chair frame when said linearly retractable actuator shortens the length.

11. The massage chair as claimed in claim 10, wherein said chair frame includes one backrest frame on which the massage device is mounted.

* * * * *